US006325720B1

(12) United States Patent
Tsukahara et al.

(10) Patent No.: US 6,325,720 B1
(45) Date of Patent: Dec. 4, 2001

(54) GAME MACHINE

(75) Inventors: Nakayasu Tsukahara; Mitsuaki Kusanagi; Takeo Koyama, all of Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/190,134

(22) Filed: Nov. 12, 1998

(30) Foreign Application Priority Data

Nov. 18, 1997 (JP) ..... 9-334982

(51) Int. Cl.[7] ..... A63F 9/24
(52) U.S. Cl. ..... 463/38; 463/20
(58) Field of Search ..... 463/20, 21, 16, 463/17, 22, 30, 37, 38, 43; 273/143 R; 345/161, 166, 170

(56) References Cited

U.S. PATENT DOCUMENTS

| | | | | |
|---|---|---|---|---|
| 4,607,159 | * | 8/1986 | Goodson et al. | 250/221 |
| 5,117,102 | * | 5/1992 | Mitchell | 250/229 |
| 5,724,068 | * | 3/1998 | Sanchez et al. | 345/161 |

FOREIGN PATENT DOCUMENTS

| | | |
|---|---|---|
| 0 141 264 A2 | 5/1985 | (EP) . |
| 0 164 877 A1 | 12/1985 | (EP) . |
| 0 513 363 A1 | 11/1992 | (EP) . |
| 0649 671 A1 | 4/1995 | (EP) . |
| 2 158 667 A | 11/1985 | (GB) . |

* cited by examiner

*Primary Examiner*—Jessica J. Harrison
*Assistant Examiner*—Kim T. Nguyen
(74) *Attorney, Agent, or Firm*—Venable; Richard L. Aitken

(57) ABSTRACT

A game machine comprises a housing, a lever pivotally supported on the housing and a control unit. The lever comprises a rod portion having a handle portion integrally formed at the front section and a sensor actuating portion integrally formed at the rear section. The game machine comprises a resiliently urging member for resiliently urging the rod portion toward a neutral position from first and second positions. The game machine further comprises first and second optical sensors positioned to have the lights intercepted by the sensor actuating portion of the lever when the rod portion of the lever is moved to the first and second positions, respectively. The control unit is operable to selectively perform predetermined first and second operations in accordance with signals outputted from the first and second optical sensors, respectively.

13 Claims, 7 Drawing Sheets

GAME MACHINE

BACKGROUND OF THE INVENTION

1. Field of the Invention

The present invention relates to a game machine for allowing a player to play a game, and more particularly to a game machine such as a slot machine.

2. Description of the Related Art

In general, a typical conventional slot machine comprises a plurality of rotatable annular reels each of which is provided with different symbols on its outer surface. Recently, there has been proposed another slot machine comprising a plurality of display units each having a window capable of simulating the annular reels to display series of different symbols changed at random on the window.

When the player plays the game, the player initially inserts medals to the game machine and determines a betting condition including a number of medals to be betted and prize-winning line. The reels start rotating in response to the player's instruction. The reels then stop rotating in response to the player's instruction. The reels may automatically stop rotating after passing predetermined time duration. The game machine is thus operated to evaluate the combination of symbols on the predetermined prize-winning line to award a winning prize point to the player.

The game machine of this type comprises a control unit for executing a game program and a storing unit electrically connected to the control unit. The storing unit may include a ROM for storing therein the game program executed by the control unit, a RAM for serving as a work area for the control unit and a register for storing therein a credit point indicative of a total number of credit medals and so on.

This type of game machine is shown in FIG. 6 of the drawings to comprise a housing 50 and various operational buttons including three different betting buttons 51, 52 and 53, a start lever 14 and three different stop buttons 56, 57 and 58, a dispense button 64, and a medal slot 66. The housing 50 has a front panel 55 having three windows w1 to w3 through each of which three symbols aligned lengthwise are displayed. Each of the betting buttons 51, 52 and 53 may be constructed by a push button. The betting buttons 51, 52 and 53 are designed to allow the player to determine a betting point, e.g., one, two and three medals, respectively, to be betted for playing the game. The betting point is indicative of the number of medals betted for playing the game by the player. The medals to be betted may be coins, tokens, a prepaid card or the like. The game machine of this type may be provided with three different prize-winning lines consists of a middle transverse line 61, upper and lower transverse lines 62, and slanting lines 63 as shown in FIG. 6. The betting buttons 51, 52 and 53 are operated by the player to have the prize-winning lines 61, 62 and 63 determined, respectively, as well as the betting point determined.

Each of prize-winning lines has three symbols displayed thereon. The game machine is designed to evaluate the combination of three symbols on each of the determined prize-winning lines to award the winning prize point to the player on the basis of the betting point.

The start lever 14 is pivotally supported on the housing 50 and upwardly and downwardly movable to assume a neutral position, an upper position and a lower position. The neutral position is located between the upper and lower positions. When the start lever 14 is operated by the player to be positioned at one of the upper and lower positions, all of the reels start to rotate to have the symbols displayed through the windows w1 to w3.

The stop buttons 56 to 58 are designed to allow the player to selectively stop the reels moved to have the combination of the symbols displayed through the windows w1 to w3 defined, respectively. Each of the stop buttons 56 to 58 may be constructed by a push button.

When the combination of the symbols are defined, the control unit is operated to evaluate the combination of the symbols on the basis of the prize-winning line predetermined by the player. When the symbols on the predetermined prize-winning line are identical with each other, the winning prize point corresponding to the betting point is awarded to the player. At this time, the winning prize point is added to the credit point and stored in the register.

When the dispenser button 64 is operated by the player, the control unit is operated to dispense the medals corresponding to the credit point stored in the register to the player and to stop executing the game.

As shown in FIG. 7, the game machine further comprise a lever assembly 11 which comprises a rod portion 12 having a front half section extending outwardly of the housing 50 and a rear half section extending inwardly of the housing 50, and an axle portion 13 integrally formed with the longitudinally intermediate portion of the rod portion 12 and having a center axis 13*a* substantially perpendicular to the center axis 12*a* of the rod portion 12. The axle portion 13 is pivotally supported on the housing 50 and pivotal about the center axis 13*a* thereof. The lever assembly 11 further comprises a handle portion 14 integrally formed with the front end of the rod portion 12 and a sensor actuating portion 16 integrally formed with the rear end of the rod portion 12. The handle portion 14 is movable to assume three different positions consisting of neutral, upper and lower positions. The neutral position is located between the upper and lower positions. The rod portion 12 is pivotable around the center axis 13*a* of the axle portion 13 to ensure that the handle portion 14 is movable to the upper and lower positions from the neutral position.

The lever assembly 11 comprises a resiliently urging member 15 for resiliently urging the rod portion 12 of the lever assembly 11 toward the neutral position from the upper and lower positions. The resiliently urging member 15 is constructed of a pair of tensile coil springs 17 each having a center axis 17*a* extending in perpendicular relationship to the center axis 13*a* of the axle portion 13 of the lever assembly 11.

The lever assembly 11 comprises an optical sensor 18 including a light source 18*a* for projecting a light on a light path L substantially perpendicular to the center axis 12*a* of the rod portion 12 of the lever assembly 11 and a light detector 18*b* for detecting the light projected from the light source 18*a*. The center axis 17*a* of a pair of tensile coil springs 17 is also perpendicular to the light path L of the optical sensor 18. The tensile coil springs 17 have one ends securely connected to the housing 50 and the other ends securely connected to the rear half section of the rod portion 12 of the lever assembly 11.

The optical sensor 18 is positioned to have the projected light intercepted by the sensor actuating portion 16 of the lever assembly 11 when the rod portion 12 of the lever assembly 11 is located at the neutral position. The optical sensor 18 is operated to issue an instruction to the control unit when the light passes from the light source 18a to the light detector 18*b*, i.e., when the rod portion 12 of the lever assembly 11 is positioned to one of the upper and lower positions.

When the player plays the game on the game machine thus constructed, the player operates the game machine through the following steps: operating one of the betting buttons 51 to 53 to determine the betting condition, operating the handle portion 14 of the lever assembly 11 to have the reels start rotating, operating all of the stop buttons 56 to 58 to have the reels stop rotating. When the player intends to repeatedly play the game, all of the aforesaid steps are repeated. The player is liable to be tired due to the repetition of the operations. As shown in FIG. 6, there is a distance between the betting buttons 51 to 53 and the handle portion 14 of the lever assembly 11 which is not less than 5 cm. Therefore, the player should move his hand through a wide range enough to traverse the distance between the betting buttons 51 to 53 and the handle portion 14 of the lever assembly 11. As a result, this operation prevents the player from being prompt to play the game as well as the player is inclined to be exhausted by this operation.

SUMMARY OF THE INVENTION

In view of the foregoing problems, it is an object of the present invention to provide a game machine capable of reducing the laborious operations for playing the game.

In accordance with a first aspect of the present invention, there is provided a game machine for allowing a player to play a game through the steps of: determining a betting condition including a betting point and a prize-winning line under which the game is executed to evaluate a result of playing the game; starting to change an arrangement of different symbols at random; stopping changing the arrangement of the symbols; and evaluating the result of playing the game on the basis of the arrangement of the symbols and the determined betting condition to award a winning prize point to the player.

The game machine comprises: a housing having a front panel having a plurality of windows each displaying the symbols arranged thereon and changed at random at predetermined intervals; a control unit for executing the game to perform a betting operation for accepting the betting condition under which the game is executed to evaluate the result of playing the game, to perform a start operation for starting to display through the windows the symbols changed at random and to perform a stop operation for stopping changing the symbols displayed through the windows to evaluate the result of playing the game on the basis of the betting condition to award the winning prize point to the player by judging whether the symbols on the prize-winning line are identical with each other or not; and a lever arm.

The lever arm includes a rod portion having a front half section extending outwardly of the housing and a rear half section extending inwardly of the housing, and an axle portion integrally formed with the longitudinally intermediate portion of the rod portion and having a center axis substantially perpendicular to the center axis of the rod portion.

The axle portion of the lever arm is supported on the housing and pivotal about the center axis thereof. The lever arm further includes a handle portion integrally formed with the front end of the rod portion and movable to assume three different positions consisting of neutral, first and second positions. The first and second positions are substantially opposite to each other. The neutral position is located between the first and second positions.

The lever arm further includes a sensor actuating portion integrally formed with the rear end of the rod portion. The rod portion is pivotable around the center axis of the axle portion to cause the rod portion to be rockable about the center axis of the axle portion to ensure that the handle portion is movable to the first and second positions from the neutral position.

The game machine further comprises: a resiliently urging member for resiliently urging the rod portion of the lever arm toward the neutral position from the first and second positions; and first and second optical sensors each including a light source for projecting a light on a light path substantially perpendicular to the center axis of the rod portion of the lever arm and a light detector for detecting the light projected from the light source.

The first and second optical sensors are spaced apart from each other to have the light paths substantially parallel with each other. The first optical sensor is positioned to have the projected light intercepted by the sensor actuating portion of the lever arm when the rod portion of the lever arm is located at the first position. The second optical sensor is positioned to have the projected light intercepted by the sensor actuating portion of the lever arm when the rod portion of the lever arm is located at the second position. The first and second optical sensors are operated to issue first and second instructions to the control unit when the lights are intercepted from the light sources of the first and second optical sensors, respectively, by the sensor actuating portion of the lever arm.

In the game machine, the control unit is operable to selectively perform the betting operation and the start operation in response to the first and second instructions received from the first and second optical sensors, respectively.

In the aforesaid game machine, the resiliently urging member may comprise a pair of tensile coil springs each having a center axis extending in perpendicular relationship to the center axis of the axle portion of the lever arm and the light paths of the first and second optical sensors and having one ends securely connected to the housing and the other ends securely connected to the rear half section of the rod portion of the lever arm.

The game machine further comprises a storage device for storing therein the betting condition.

In accordance with a second aspect of the present invention, there is provided a game machine for allowing a player to play a game through the steps of: determining a betting condition including a betting point and a prize-winning line under which the game is executed to evaluate a result of playing the game; starting to change an arrangement of different symbols at random; stopping changing the arrangement of the symbols; and evaluating the result of playing the game on the basis of the arrangement of the symbols and the determined betting condition to award a winning prize point to the player. The game machine comprises: a housing having a front panel having a plurality of windows each displaying the symbols arranged thereon and changed at random at predetermined intervals; a control unit for executing the game to perform a betting operation for accepting the betting condition under which the game is executed to evaluate the result of playing the game, to perform a start operation for starting to display through the windows the symbols changed at random and to perform a stop operation for stopping changing the symbols displayed through the windows to evaluate the result of playing the game on the basis of the betting condition to award the winning prize point to the player by judging whether the symbols on the prize-winning line are identical with each other or not.

The game machine further comprises a lever arm including a rod portion having a front half section extending outwardly of the housing and a rear half section extending inwardly of the housing, and an axle portion integrally formed with the longitudinally intermediate portion of the rod portion and having a horizontal axis and a vertical axis substantially perpendicular to the center axis of the rod portion. The axle portion of the lever arm is pivotally supported on the housing and pivotal about the horizontal and vertical axes.

The lever arm further includes a handle portion integrally formed with the front end of the rod portion and movable to assume four different positions consisting of neutral, first, second and third positions, the second and third positions substantially opposite to each other, the neutral position located within the first, second and third positions. The lever arm further includes a reflecting portion for reflecting a light and integrally formed with the rear end of the rod portion. The rod portion of the lever arm is pivotable around the horizontal and vertical axes of the axle portion to cause the rod portion to be rockable about the horizontal and vertical axes of the axle portion to ensure that the handle portion is movable to the first, second and third positions from the neutral position.

The game machine further comprises a resiliently urging member for resiliently urging the rod portion of the lever arm toward the neutral position from the first, second and third positions. The machine further comprises a first optical sensor including a light source for projecting a light and a light detector for detecting the light projected from the light source. The first optical sensor is positioned to have the projected light reflected by the reflecting portion of the rod portion of the lever arm toward the light detector of the first optical sensor when the rod portion of the lever arm is located at the neutral position.

The machine further comprises a second optical sensor including a light source for projecting a light and a light detector for detecting the light projected from the light source. The second optical sensor is positioned to have the projected light reflected by the reflecting portion of the rod portion of the lever arm toward the light detector of the second optical sensor when the rod portion of the lever arm is located at the first position.

In the game machine, the first optical sensor is operated to issue a first instruction to the control unit when the light detector of the first optical sensor is prevented from detecting the light projected from the light source of the first optical sensor, while the second optical sensor is operated to issue a second instruction to the control unit when the light detector of the second optical sensor is operated to detect the light projected from the light source of the second optical sensor.

In the game machine, the control unit is operable to selectively perform the betting and start operations in response to the first and second instructions received from the first and second optical sensors, respectively.

In the aforesaid game machine, the resiliently urging member may comprise two pairs of tensile coil springs each having a center axis extending in parallel relationship with the horizontal and vertical axes of the axle portion of the lever arm. The horizontal and vertical axes of the two pairs of tensile coil springs are substantially perpendicular to each other and the two pairs of tensile coil springs each having one ends securely connected to the housing and the other ends securely connected to the rear half section of the rod portion of the lever arm.

The aforesaid game machine may further comprise a storage device for storing therein the betting condition.

In accordance with a third aspect of the present invention, there is provided a game machine for allowing a player to play a game comprising: control means for executing the game; and handling means for allowing the player to instruct the control means to perform first and second predetermined operations and for issuing first and second predetermined instructions, respectively, to the control means. In the game machine, the control means is operable to selectively perform the first and second operations in response to the first and second instructions, respectively.

BRIEF DESCRIPTION OF THE DRAWINGS

The present invention and many of the advantages thereof will be better understood from the following detailed description when considered in connection with the accompanying drawings, wherein.

DESCRIPTION OF THE PREFERRED EMBODIMENTS

Figure 1:
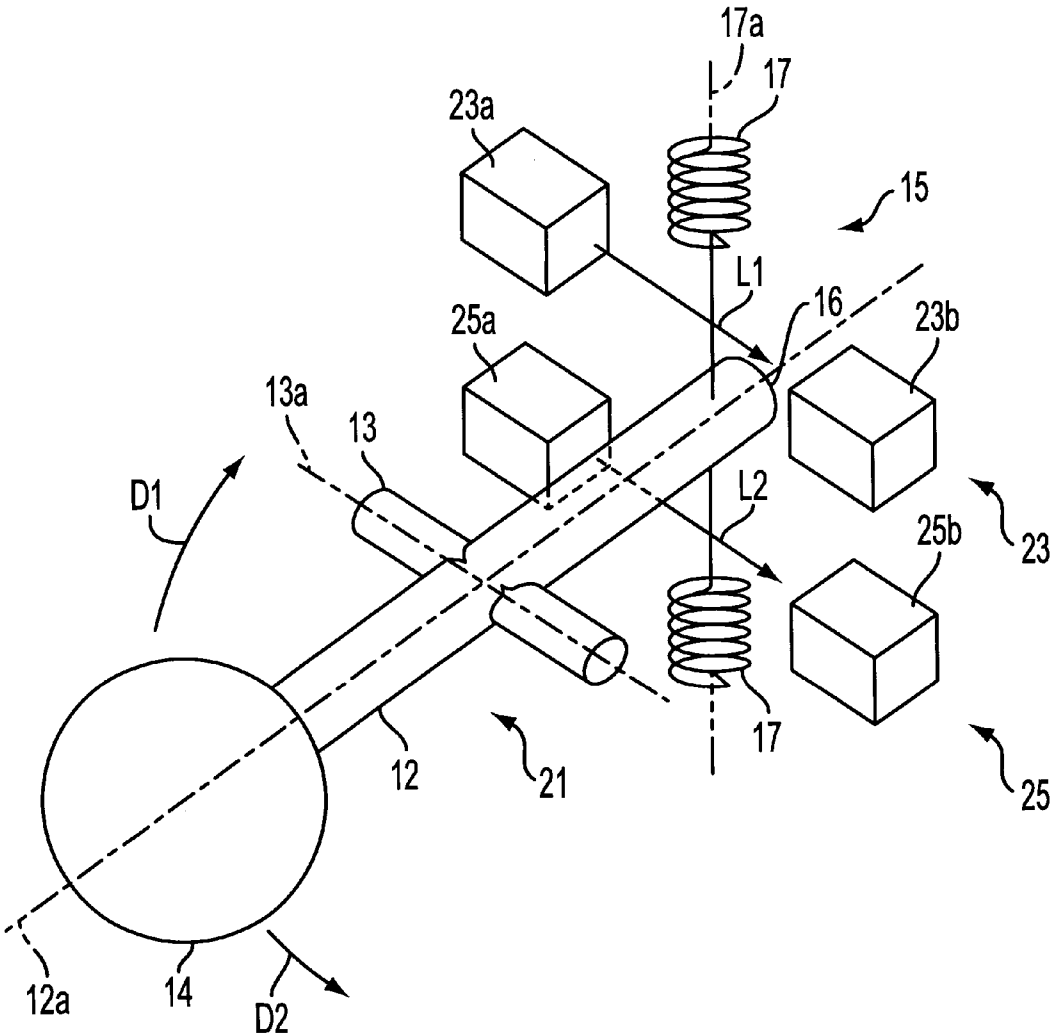
FIG. 1 is a perspective view of a first embodiment of a lever assembly forming part of the game machine according to the present invention.
Figure 2:
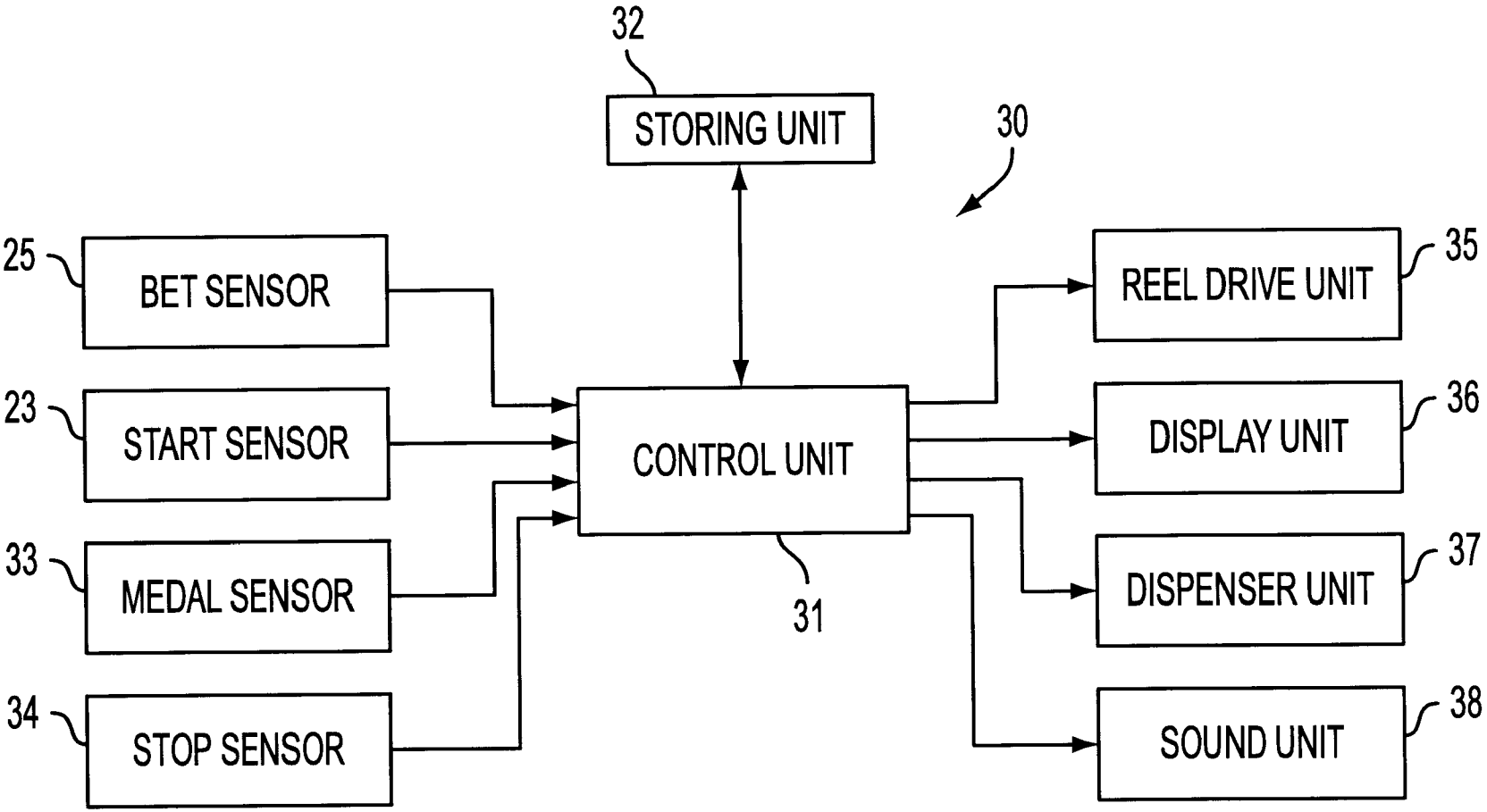
FIG. 2 is a block diagram showing a circuit of the game machine shown in FIG. 1.
Figure 3:
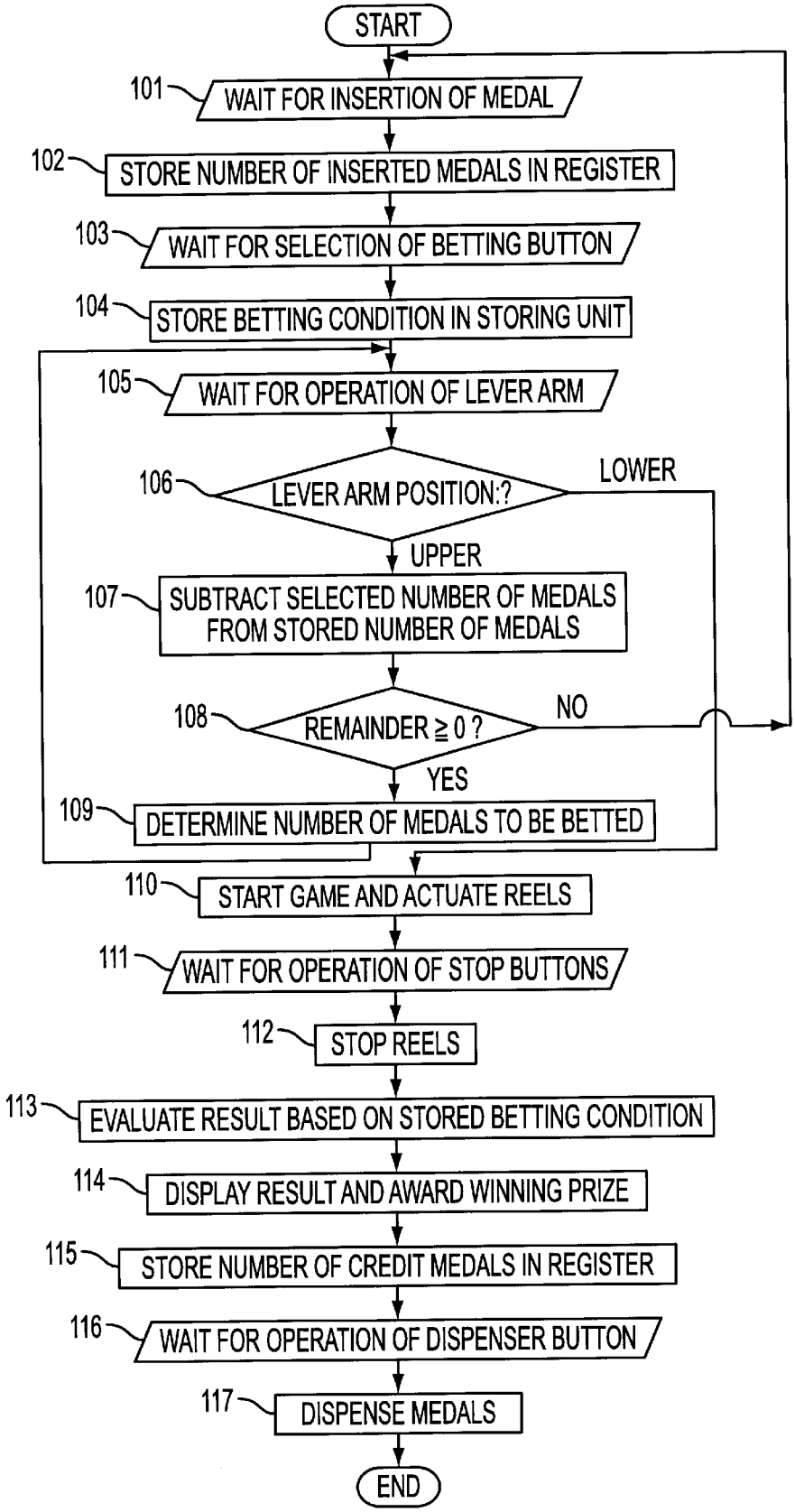
FIG. 3 is a flowchart showing the flow of the process of a control unit forming part of the game machine shown in FIG. 2.

Referring now to FIGS. 1 to 3 of the drawings, there is shown a first preferred embodiment of the game machine according to the present invention.

Figure 6:
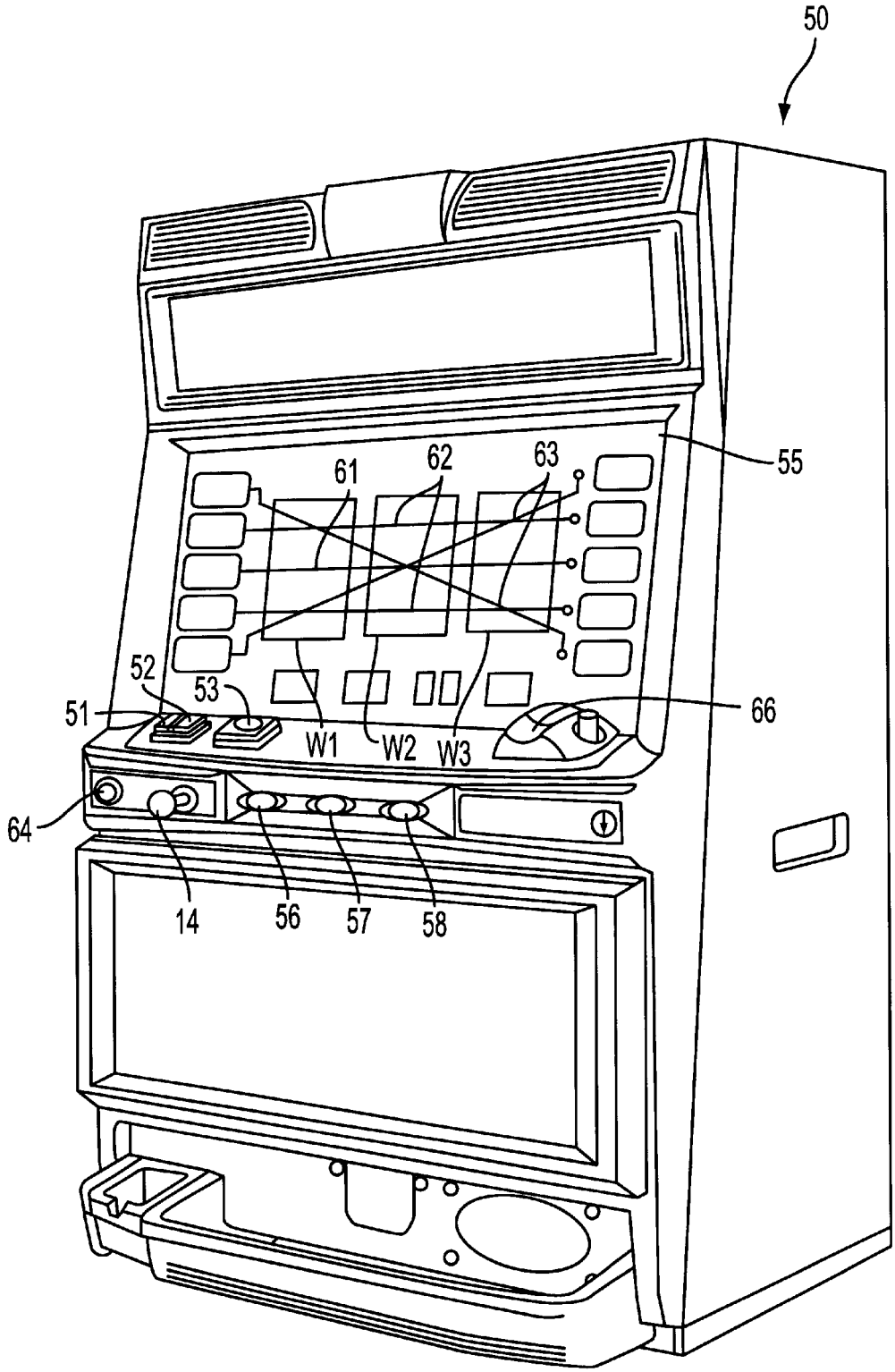
FIG. 6 (PRIOR ART)
FIG. 6 is a perspective view of a typical conventional game machine.

In this embodiment, the game machine may be a slot machine substantially identical to the game machine which is shown in FIG. 6 and adapted to allow a player to play a game through the following steps: determining a betting condition including a betting point and a prize-winning line under which the game is executed to evaluate a result of playing the game; starting to change an arrangement of different symbols at random; stopping changing the arrangement of the symbols; and evaluating the result of playing the game on the basis of the arrangement of the symbols and the determined betting condition to award a winning prize point to the player.

Figure 7:
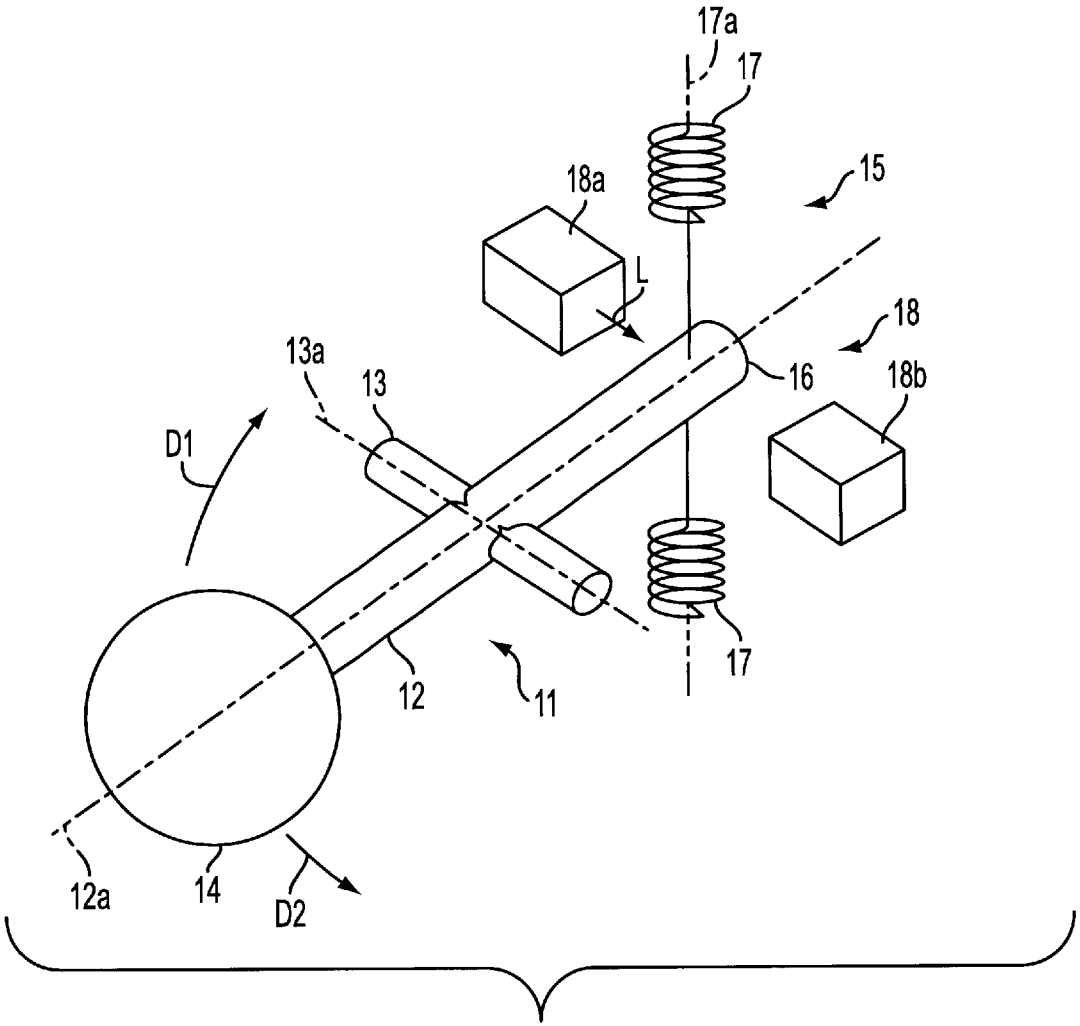
FIG. 7 (PRIOR ART)
FIG. 7 is a perspective view of a conventional lever assembly of the game machine shown in FIG. 6.

The first embodiment of the game machine comprises the same constitutional elements as those of the aforesaid game machine shown in FIGS. 6 and 7. These same constitutional elements are simply represented by the same reference numerals as those of the game machine shown in FIGS. 6 and 7, and will thus be omitted in description for avoiding tedious repetition.

Referring to FIG. 1 of the drawings, there is shown a lever assembly 21 of the game machine of the first embodiment. The lever assembly 21 comprises the same constitutional elements as those shown in FIG. 7 and thus including the rod portion 12, the axle portion 13, the handle portion 14, and the sensor actuating portion 16. In this embodiment, the rod portion 12 of the lever assembly 21 can be pivotal about the center axis 13*a* to assume the upper and lower positions by moving the handle portion 14 of the lever assembly 21 in upward and downward directions D1 and D2, respectively, as shown in FIG. 1. The lever assembly 21 further comprises the resiliently urging member 15 having a pair of tensile coil springs 17 which are the same constitutional elements as those shown in FIG. 7.

The lever assembly 21 further comprises first and second optical sensors 23 and 25. The first optical sensor 23 includes a light source 23*a* for projecting a light on a light path L1 substantially perpendicular to the center axis 12*a* of the rod portion 12 of the lever assembly 21 and a light detector 23*b* for detecting the light projected from the light source 23*a*. The second optical sensor 25 includes a light source 25*a* for projecting a light on a light path L2 substantially perpendicular to the center axis 12*a* of the rod portion 12 of the lever assembly 21 and a light detector 25*b* for detecting the light projected from the light source 25*a*.

The first and second optical sensors 23 and 25 are spaced apart from each other to have the respective light paths L1 and L2 substantially parallel with each other. The first optical sensor 23 is positioned to have the projected light intercepted by the sensor actuating portion 16 of the lever assembly 21 when the rod portion 12 of the lever assembly 21 is located at the lower position. On the other hand, the second optical sensor 25 is positioned to have the projected light intercepted by the sensor actuating portion 16 of the lever assembly 21 when the rod portion 12 of the lever assembly 21 is located at the upper position. The first and second optical sensors 23 and 25 are operated to issue the betting and starting instructions to the control unit when the lights are intercepted from the light sources 23*a* and 25*a* of the first and second optical sensors 23 and 25, respectively, by the sensor actuating portion 16 of the lever assembly 21.

The coil springs 17 of the resiliently urging member 15 are also in perpendicular relationship to the light paths L1 and L2 of the first and second optical sensors 23 and 25 and have one ends securely connected to the housing 50 and the other ends securely connected to the rear half section of the rod portion 12 of the lever assembly 21. The pair of tensile coil springs 17 work together to resiliently urge the rod portion 12 of the lever assembly 21 toward the neutral position from the upper and lower positions. This means that the rod portion 12 of the lever assembly 21 is urged to return to the neutral position by the tensile coil springs 17 even if the rod portion 12 of the lever assembly 21 is moved either to the upper position or to the lower position.

In this embodiment, the center axis 13*a* of the axle portion 13 horizontally extends, however, the axis 13*a* of the axle portion 13 may vertically extend. The axle portion 13 of the lever assembly 21 thus constructed can be rightwardly and leftwardly pivotally supported on the housing 50 and pivotal about the center axis 13*a* substantially perpendicular to the center axis 12*a* of the rod portion 12. The handle portion 14 of the lever assembly 21 may be movable to assume three different positions consisting of neutral, rightward and leftward positions. The neutral position is located between the rightward and leftward positions. The rod portion 12 of the lever assembly 21 is thus pivotal about the center axis 13a of the rod portion 12 to ensure the handle portion 14 is movable to the rightward position and leftward position from the neutral position.

In this case, the resiliently urging member 15 is adapted to resiliently urge the rod portion 12 of the lever assembly 21 toward the neutral position from the rightward and leftward positions. The first optical sensor 23 is positioned to have the projected lights intercepted by the sensor actuating portion 16 of the lever assembly 21 when the rod portion 12 of the lever assembly 21 is located at the rightward position. The second optical sensor 25 is positioned to have the projected lights intercepted by the sensor actuating portion 16 of the lever assembly 21 when the rod portion 12 of the lever assembly 21 is located at the leftward position.

Referring to FIG. 2 of the drawings, there is shown a block diagram of a circuit of the game machine of the first embodiment shown in FIG. 1. The game machine comprises a control unit 31, a storing unit 32 electrically connected to the control unit 31, and a plurality of sensors including a betting sensor which is constituted by the second optical sensor 25 shown in FIG. 1, a start sensor which is constituted by the first optical sensor 23 shown in FIG. 1, a medal sensor 33, a stop sensor 34, a reel drive unit 35, a display unit 36, a dispenser unit 37 and a sound unit 38. The control unit 31 is electrically connected to all of sensors 23, 25, 33 and 34, the reel drive unit 35, the display unit 36, the dispenser unit 37 and the sound unit 38. The control unit 31 is operable to receive an output signal from the sensors 23, 25, 33 and 34 and to output a predetermined instruction to the reel drive unit 35, the display unit 36, the dispenser unit 37 and the sound unit 38.

The control unit 31 may be constituted of a microprocessor, a ROM, a RAM and so on which are not shown in the drawings. The ROM is adapted to store a game program therein. The RAM serves as a work area for the microprocessor. The RAM has a register for storing the credit point therein. The microprocessor is operated to execute the game program stored in the ROM to control all of operations of the game machine.

As described above, the betting sensor 25 is adapted to detect that the handle portion 14 of the lever assembly 21 is moved toward the direction D1 to be positioned at the upper position. The start sensor 23 is adapted to detect that the handle portion 14 of the lever assembly 21 is moved toward the direction D2 to be positioned at the lower position.

The game machine is designed to allow a medal to be inserted through the medal slot 66. The medal sensor 33 is adapted to sense the insertion of the medal through the medal slot 66. The number of the inserted medals are counted by a medal counter (not shown). The stop sensor 34 is designed to sense each of the operations of the stop buttons 56 to 58.

The storing unit 32 is adapted to store therein the betting point corresponding to the selected betting button when the player is determined to play the game. The storing unit 32 may be partially formed by the RAM or a volatile memory. The player can select a single button to be pushed from the betting buttons 51 to 53 to determine the betting point. When one of the betting buttons 51 to 53 is pushed by the player, the betting point corresponding to the pushed button are stored in the storing unit 32. At this time, the prize-winning line corresponding to the pushed button is determined.

The reel drive unit 35 is designed to actuate the reels to start and stop rotating. The display unit 36 is designed to display a result of the game and another information on the game on its screen. The dispenser unit 37 is designed to dispense the credit points to the player. The sound unit 38 is adapted to output a sound and a voice message.

Referring to FIG. 3 of the drawings, there is shown a flowchart showing the flow of the process of the control unit 31 shown in FIG. 2.

The control unit 31 is operated to execute the game program through the steps 101 to 117 as shown in FIG. 3 when the game machine starts to execute the game. In the step 101, the control unit 31 is operated to wait for the insertion of the medals through the medal slot 66 on the basis of the signal outputted from the medal sensor 33. When the control unit 31 is operated to received the signal from the medal sensor 33, the step 101 goes to the step 102 in which the number of the inserted medals is added to the credit point and then stored in the register. The step 102 then goes to the step 103 in which the control unit 31 is operated to wait for the selection of the betting buttons 51 to 53.

In the following step 104, the betting point corresponding to the selected betting button is stored in the storing unit 32. In the step 105, the control unit 31 is operated to wait for the operation of the lever assembly 21 on the basis of the signal outputted from the betting sensor 25 and the start sensor 23. When the lever assembly 21 is operated by the player, the step 105 goes to the step 106 in which the judgment is made upon to which of positions the lever assembly 21 is moved from the neutral position.

When the lever assembly 21 is moved to the upper position from the neutral position, the light is intercepted from the light source 25a of the second optical sensor 25 by the sensor actuating portion 16 of the rod portion 12. At this time, the betting sensor 25 is operated to output the signal to the control unit 31. The control unit 31 can judge that the rod portion 12 of the lever assembly 21 is moved to the upper position from the neutral position. When the judgment in the step 106 is made that the rod portion 12 of the lever assembly 21 is moved to the upper position, the step 106 goes to the step 107.

When, on the other hand, the lever assembly 21 is moved to the lower position from the neutral position, the light is intercepted from the light source 23a of the start sensor 23 by the sensor actuating portion 16 of the rod portion 12. At this time, the start sensor 23 is operated to output the signal to the control unit 31. The control unit 31 can judge that the rod portion 12 of the lever assembly 21 is moved to the lower position from the neutral position. When the judgment in the step 106 is made that the rod portion 12 of the lever assembly 21 is moved to the lower position, the step 106 goes to the step 110.

As described above, the control unit 31 is operable to selectively perform a betting operation in the following steps 107 to 109 and a start operation in the following step 110 in response to the signal received from the betting and start sensors 23 and 25.

In the step 107, the control unit 31 is operated to subtract the betting point corresponding to the selected betting button from the credit point stored in the register. In the step 108, the control unit 31 is operated to judge whether the remainders are no less than zero or not. When the answer in the step 108 is in the affirmative "YES", the step 108 goes to the step 109. When, on the other hand, the answer in the step 108 is in the negative "NO", the step 108 is returned to the step 101. In the step 109, the control unit 31 is operated to determine the betting point stored in the storing unit 32 to be betted in this game. The step 109 is then returned to the step 105.

In the step 110, the control unit 31 is operated to instruct the reel drive unit 35 to be actuated. In this embodiment, the reels are virtually displayed on the windows w1 to w3 to have an arrangement of symbols changed at random at predetermined intervals. The game machine may comprises a plurality of annular reels axially aligned and rotatable about an axis. Each of reels has an outer surface having different symbols indicated thereon. When the reels are rotated about the axis, the different symbols are displayed through the windows w1 to w3.

In the following step 111, the control unit 31 is operated to wait for the operations of the stop buttons 56 to 68. When the stop buttons 56 to 58 are operated by the player, the stop sensor 34 is operated to output the signal to the control unit 31. The control unit 31 is then operated to instruct the reel drive unit 35 to stop changing the symbols displayed on the windows w1 to w3 in response to the signal from the stop sensor 34 in the step 112.

The control unit 31 is then operated to evaluate a result of playing game on the basis of the arrangement of symbols and the determined betting condition in the step 113. The control unit 31 is operated to judge whether the symbols on the prize-winning line are identical with each other or not. The control unit 31 is further operated to determine a winning prize point on the basis of the above judgment and the betting point. The control unit 31 is operated to instruct the display unit 36 to display the result of playing game and the winning prize point to be awarded to the player in the step 114. The control unit 31 is operated to add the winning prize point to the credit point stored in the register in the step 115. In the step 116, the control unit 31 is operated to wait for the operation of the dispenser button 64. When the dispenser button 64 is operated by the player, the control unit 31 is operated to instruct the dispenser unit 37 to dispense the medals corresponding to the credit point to the player in the step 117.

The game machine may continue to execute the game. In this case, the step 115 is returned to step 103. The steps 103 and 105 are monitored at the same time. When the operation of one of the betting buttons 51 to 53 is detected, the control passes from the step 103 to the step 104. When, on the other hand, the operation of the lever assembly 21 is detected, the control bypasses the steps 103 to 104 and passes from the step 105 to the step 106.

The operation of the game machine will be described hereinlater.

When the game machine starts to execute the game, the control unit 31 starts to execute the game program through the steps shown in FIG. 3 as described above. The control unit 31 waits for the insertion of the medals in the step 101. When the player inserts the medals to the game machine through the medal slot 66, the medal sensor 33 detects the insertion of the medals to output the signal to the control unit 31. Here, the number of inserted medals is assumed to be two to cause the credit point to be set to two. The control unit 31 stores the number of the inserted medals in the register in the step 102. The control unit 31 then waits for the selection of the betting button in the step 103.

When the player operates the betting button 52, the betting point is two and stored in the storing unit 32 in the step 104. At the same time, the upper and lower prize winning lines 62 are selected as the betting condition. The control unit 31 then waits for the operation of the lever assembly 21. At this time, the first and second sensors 23 and 25 detect the lights from the light sources 23*a* and 25*a*.

When the player operates the lever assembly 21 to have the handle portion 14 moved to the upper position, the light is intercepted from the light source 25*a* of the second optical sensor 25, i.e., the betting sensor 25 by the sensor actuating portion 16 of the lever assembly 21. The light detector 25*b* of the betting sensor 25 therefore cannot detect the light projected from the light source 25*a*. The betting sensor 25 outputs the signal to the control unit 31. In response to the signal from the betting sensor 25, the control unit 31 is operated to subtract the betting point stored in the storing unit 32 from the credit point stored in the register in the step 107. The betting point stored in the storing unit 32 is two, while the credit point stored in the register is also two. Accordingly, the remainder is zero. Then, the answer in the step 108 is in the affirmative "YES", and therefore the step 108 goes to the step 109. The control unit 31 determines that the betting point is two on the basis of the betting point stored in the storing unit 32. Then the step 109 is returned to the step 105.

The control unit 31 waits for the operation of the lever assembly 21 in the step 105. When the player operates the lever assembly 21, the step 105 goes to the step 106. Here, the player operates the handle portion 14 of the lever assembly 21 to move to the lower position. At this time, the light is intercepted from the light source 23*a* of the start sensor 23 by the sensor actuating portion 16 of the lever assembly 21. Therefore, the light detector 23*b* of the start sensor 23 cannot detect the light from the light source 23*a*. The start sensor 23 is operated to output the signal to the control unit 31. In response to the signal from the start sensor, the judgment is made in the step 106 that the lever assembly 21 is positioned at lower position. Then the step 106 goes to the step 110 in which the control unit 31 is operated to instruct the reel drive unit 35 to start rotating the reels.

The control unit 31 waits for the operation of the stop buttons in the step 110. The player operates the stop buttons 56 to 58 to stop the corresponding reels. The stop sensor 34 detects the operation of the stop buttons 56 to 58 to output the signal to the control unit 31. The control unit 31 is operated to instruct the reel drive unit 35 to stop the reel corresponding to the operated stop button in response to the signal outputted from the stop sensor 34 in the step 112.

When all of the reels stop rotating, the control unit 31 is operated to evaluate the result of playing the game in the step 113. The control unit 31 judges whether three symbols on one of the upper and lower prize-winning lines are identical with each other or not. When the three symbols on the upper prize-winning line is identical with each other, the control unit 31 awards the winning prize point to the player on the basis of the betting point. The winning prize point, e.g., two medals, is added to the credit point to be stored in the register. At this time, the control unit 31 is operated to instruct the display unit 36 to display this result.

The control unit 31 waits for the operation of the dispenser button 64 in the step 116. At the same time, the control unit 31 is operable to monitor the operation of the betting buttons 56 to 58 and the operation of the lever assembly 21. When the player does not operate the dispenser button 64 and operate the lever assembly 21, the control unit 31 judges whether the handle portion 14 of the lever assembly 21 is moved to the upper position or the lower position in the step 106.

When the player operates the handle portion 14 of the lever assembly 21 to be moved to the upper position, the control unit 31 performs the subtraction in the step 107. At this time, the betting point is two, while the credit point is four. The remainder is two, accordingly, larger than zero. Then the control unit 31 determines that the betting point is two and that the prize-winning line is the upper or lower prize-winning line.

When the player operates the handle portion 14 of the lever assembly 21 to be moved to the lower position, the control unit 31 instructs the reel drive unit 35 to start rotating. The player then operates the stop buttons 56 to 58 to have the reels stop rotating. The control unit 31 is operated to evaluate the result of the game on the basis of the combination of symbols on the prize-winning lines in the step 113 and to instruct the display unit 36 to display the result on its screen.

The player can repeat the operations of the lever assembly 21 and the stop buttons 56 to 58 without operating the betting buttons 51 to 53 except for the first time as described above, so that the games can be repeated.

When the player wants to change the betting point, the player selectively operates a desired betting button before the handle portion 14 of the lever assembly 21 is operated. The selected betting point corresponding to the selected betting button is then stored in the storing unit 32. Thereafter, the control unit 31 is operable to evaluate the result of playing the game under this betting condition including the betting point.

Figure 4:
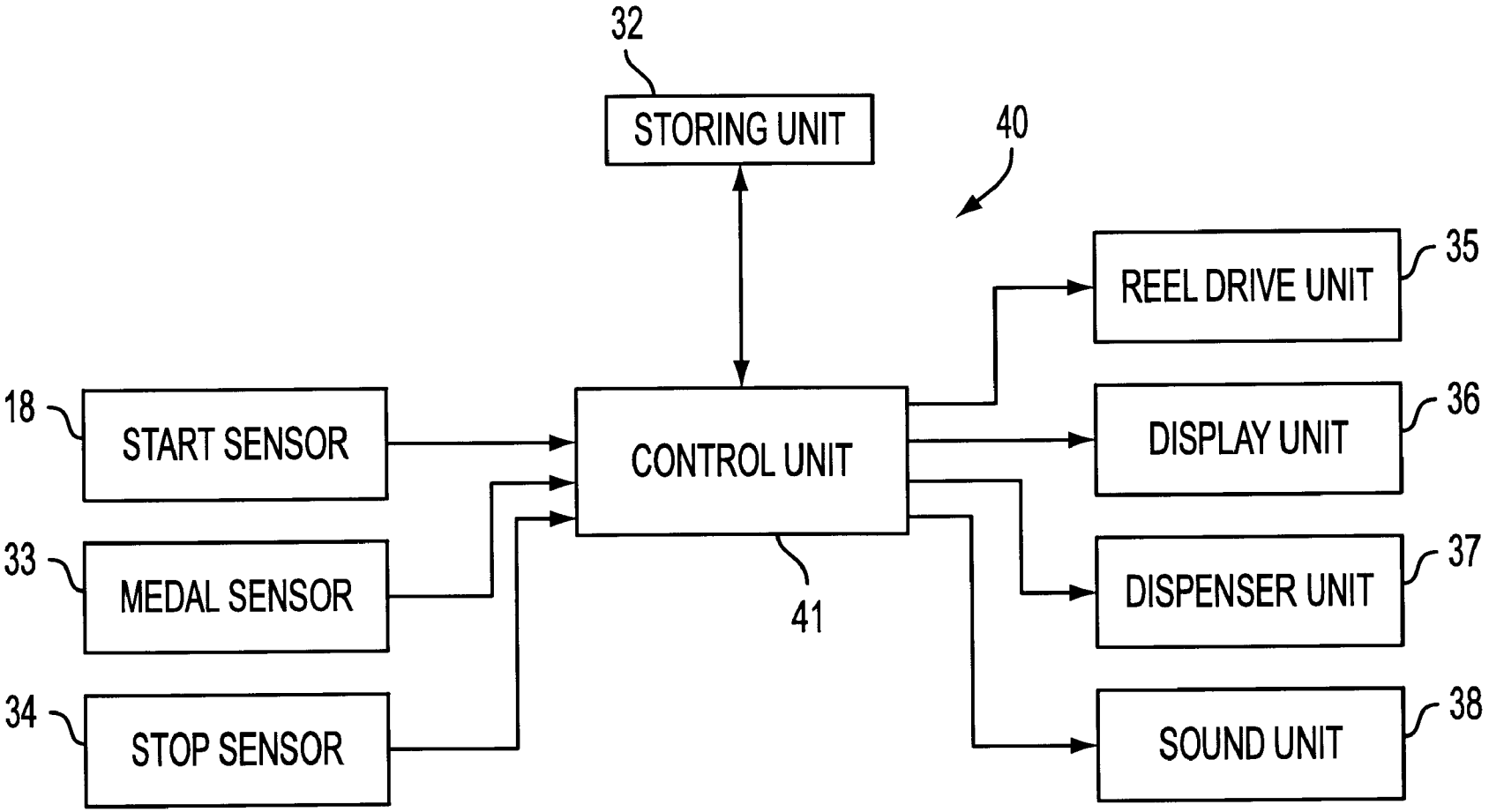
FIG. 4 is a block diagram showing another circuit of the game machine shown in FIG. 1.

The control unit 31 shown in FIG. 3 may be alternated with a control unit 41 as shown in FIG. 4. In this example, the game machine comprises the same lever assembly 11 as that shown in FIG. 7. The control unit 41 is electrically connected to the start sensor 18, the medal sensor 33, the stop sensor 34, the storing unit 32, the reel drive unit 35, the display unit 36, the dispenser unit 37 and the sound unit 38.

The storing unit 32 can store a predetermined betting condition. The game machine thus constructed can play the game under the predetermined betting condition stored in the storing unit 32. The control unit 41 is operated to receive the signal outputted from the start sensor 18 when the player moves the lever assembly 11 to an upper position or a lower position. The control unit 41 is operated to instruct the reel drive unit 35 to start rotating in response to the signal from the start sensor 18.

The control unit 41 is operated to stop the reels in response to the signal from the stop sensor 34. The control unit 41 is then operated to evaluate the result of the game on the basis of the betting condition stored in the storing unit 32.

The betting condition includes the betting point indicative of a number of medals to be betted and a prize-winning line and may be modified if desired. The modified betting condition is stored in the storing unit 32 and used for evaluating the result of the game.

Figure 5:
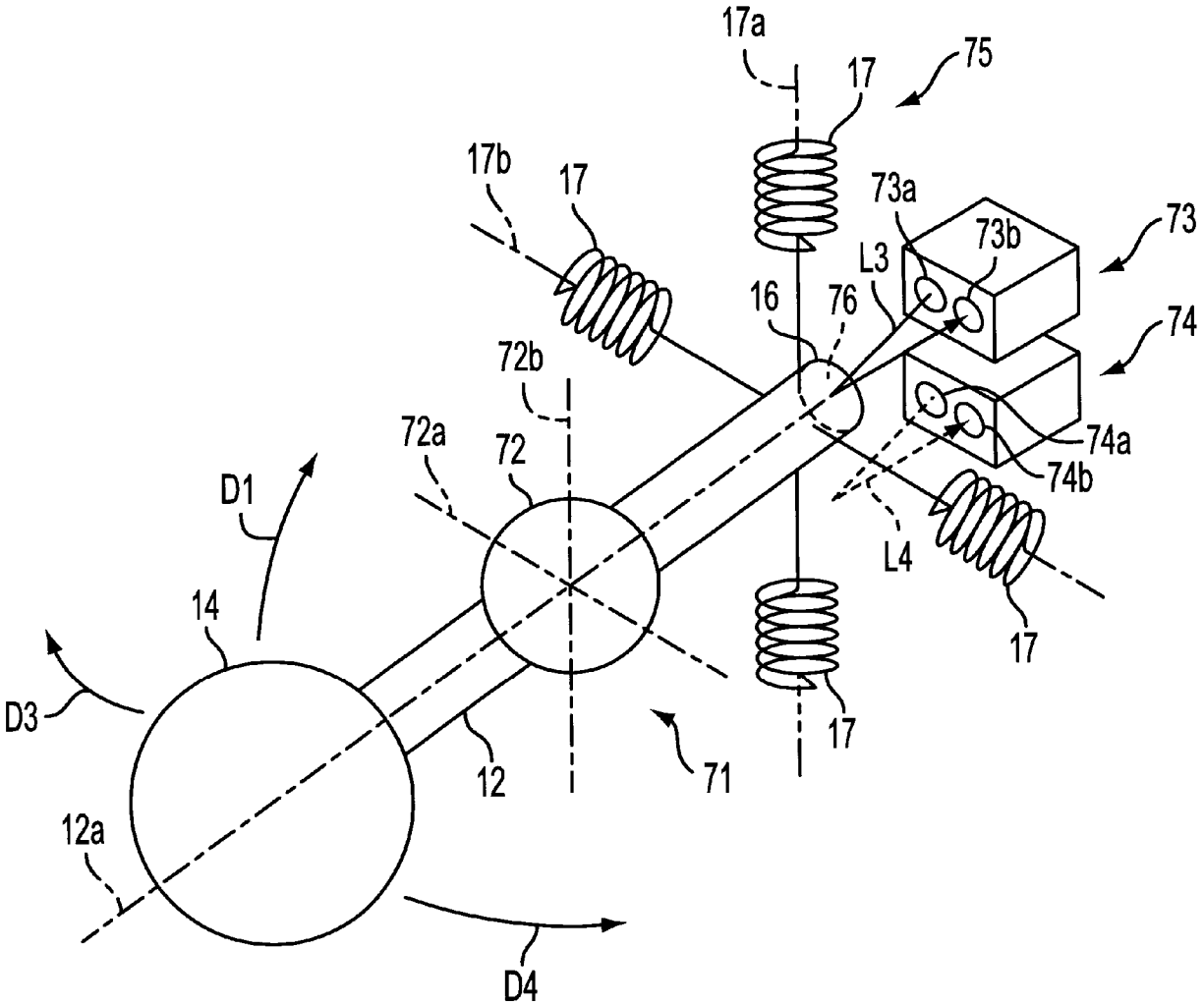
FIG. 5 is a perspective view of a second embodiment of the lever assembly of the game machine according to the present invention.

Referring to FIG. 5 of the drawings, there is shown a second preferred embodiment of the game machine according to the present invention. The second preferred embodiment of the game machine comprises a lever assembly 71 shown in FIG. 5. The lever assembly 71 comprises the same constitutional elements as those of the first embodiment except for the resiliently urging member 15 and the first and second sensors 23 and 25 shown in FIG. 1. The lever assembly 71 comprises a resiliently urging member 75 and first and second sensors 73 and 74 as shown in FIG. 5.

The lever assembly 71 comprises the rod portion 12 and the handle portion 14 same as those of the lever assembly 21, and an axle portion 72 integrally formed with the longitudinally intermediate portion of the rod portion 12. The axle portion 72 of the lever assembly 71 has a horizontal axis 72*a* and a vertical axis 72*b* both of which are in substantially perpendicular relationship to the center axis 12*a* of the rod portion 12. The axle portion 72 is supported on the housing 50 to have the rod portion 12 rotated about the axes 72*a* and 72*b* of the axle portion 72. The handle portion 14 of the lever assembly 71 is movable to assume four different positions consisting of a neutral position, an upper position, a rightward position and a leftward position. The neutral position is located within the upper, rightward and leftward positions. The rod portion 12 is pivotable about the axes 72*a* and 72*b* of the axle portion 72 to cause the rod portion 12 to be rockable about the axle portion 72 to ensure that the handle portion 14 is movable to the upper, rightward and leftward positions from the neutral position.

The lever assembly 71 further comprises a reflecting portion 76 for reflecting a light and integrally formed with the rear end of the rod portion 12.

In this embodiment, the rod portion 12 of the lever assembly 71 can be pivotal about the axes 72*a* and 72*b* to assume the upper, rightward and leftward positions by moving the handling portion 14 of the lever assembly 71 in upward, rightward and leftward directions D1, D3 and D4, respectively, as shown in FIG. 5.

The resiliently urging member 75 is adapted to resiliently urge the rod portion 12 of the lever assembly 71 toward the neutral position from the upper, rightward and leftward positions.

The lever assembly 71 further comprises first and second optical sensors 73 and 74. The first optical sensor 73 includes a light source 73*a* for projecting a light and a light detector 73*b* for detecting the light projected from the light source 73*a*. The first optical sensor 73 is positioned to have the projected light reflected by the reflecting portion 76 of the rod portion 12 of the lever assembly 71 toward the light detectors 73*b* of the first optical sensor 73 when the rod portion 12 of the lever assembly 71 is located at the neutral position.

The second optical sensor 74 includes a light source 74*a* for projecting a light and a light detector 74*b* for detecting the light projected from the light source 74*a*. The second optical sensor 74 is positioned to have the projected light reflected by the reflecting portion 76 of the rod portion 12 of the lever assembly 71 toward the light detectors 74*b* of the second optical sensor 74 when the rod portion 12 of the lever assembly 71 is located at the upper position.

The game machine of the second embodiment comprises the control unit 31, the storing unit 32, the medal sensor 33, the stop sensor 34, the reel drive unit 35, the display unit 36, the dispenser unit 37 and the sound unit 38 all of which are the same in construction as those shown in FIG. 2. In this embodiment, the first and second sensors 73 and 74 shown in FIG. 5 constitute the betting and start sensors 25 and 23 shown in FIG. 2, respectively.

The aforesaid first optical sensor 73 is operated to issue the betting instruction to the control unit 31 when the light detector 73*b* of the first optical sensor 73 is prevented from detecting the light projected from the light source 73*a* of the first optical sensor 73. The aforesaid second optical sensor 74 is operated to issue the starting instruction to the control unit 31 when the light detector 74*b* of the second optical sensor 74 is operated to detect the light projected from the light source 74*a* of the second optical sensor 74.

The control unit 31 is operable to selectively perform the betting and start operations in response to the betting and starting instructions received from the first and second optical sensors 73 and 74, respectively.

The operation of the second embodiment of the game machine will be described hereinlater. When the rod portion 12 of the lever assembly 71 is located at the neutral position, the first optical sensor 73 detects the light projected from the light source 73*a*, while the second optical sensor 74 cannot detect the light projected from the light source 74*a*.

When the player operates the lever assembly 71 to have the rod portion 12 moved to the upper position, the first optical sensor 73 cannot detect the light projected from the light source 73*a*. At the same time, the second optical sensor 74 detects the light projected from the light source 74*a*. The second optical sensor 74 is operated to output the signal to the control unit 31. The control unit 31 is operated to receive the signal from the second optical sensor 74 to determine the betting condition previously stored in the storing unit 32.

When the player operates the lever assembly 71 to have the rod portion 12 moved to one of the rightward and leftward positions, the first and second optical sensors 73 and 74 cannot detect the lights from the light sources 73*a* and 74*a*. The first optical sensor 73 is operated to output the signal to the output control unit 31. The control unit 31 is operated to receive the signal from the first optical sensor 73 to instruct the reel drive unit 35 to start rotating.

The game machine thus constructed has an advantage over the prior art in reducing the laborious operations for playing the game. Therefore, the player can repeat the game without tedious labors.

The many features and advantages of the invention are apparent from the detailed specification, and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described herein, and accordingly, all suitable modifications and equivalents may be construed as being encompassed within the scope of the invention.

What is claimed is:

1. A game machine for allowing a player to play a game through the steps of: determining a betting condition including a betting point and a prize-winning line under which said game is executed to evaluate a result of playing said game; starting to change an arrangement of different symbols at random; stopping changing said arrangement of said symbols; and evaluating said result of playing said game on the basis of said arrangement of said symbols and said determined betting condition to award a winning prize point to said player, comprising:

a housing having a front panel having a plurality of windows each displaying said symbols arranged thereon and changed at random at predetermined intervals;

a control unit for executing said game to perform a betting operation for accepting said betting condition under which said game is executed to evaluate the result of playing said game, to perform a start operation for starting to display through said windows said symbols changed at random and to perform a stop operation for stopping changing said symbols displayed through said windows to evaluate said result of playing said game on the basis of said betting condition to award said winning prize point to said player by judging whether said symbols on said prize-winning line are identical with each other or not;

a lever arm including a rod portion having a front half section extending outwardly of said housing and a rear half section extending inwardly of said housing, an axle portion integrally formed with the longitudinally intermediate portion of said rod portion and having a center axis substantially perpendicular to the center axis of said rod portion, said axle portion being pivotally supported on said housing and pivotal about said center axis thereof, a handle portion integrally formed with the front end of said rod portion and movable to assume three different positions consisting of neutral, first and second positions, said first and second positions substantially opposite to each other, said neutral position located between said first and second positions, and a sensor actuating portion integrally formed with the rear end of said rod portion, said rod portion being pivotable around said center axis of said axle portion to cause said rod portion to be rockable about said center axis of said axle portion to ensure that said handle portion is movable to said first and second positions from said neutral position;

a resiliently urging member for resiliently urging said rod portion of said lever arm toward said neutral position from said first and second positions; and first and second optical sensors each including a light source for projecting a light on a light path substantially perpendicular to said center axis of said rod portion of said lever arm and a light detector for detecting the light projected from said light source, said first and second optical sensors being spaced apart from each other to have said light paths substantially parallel with each other, said first optical sensor being positioned to have said projected light intercepted by said sensor actuating portion of said lever arm when said rod portion of said lever arm is located at said first position, and said second optical sensor being positioned to have said projected light intercepted by said sensor actuating portion of said lever arm when said rod portion of said lever arm is located at said second position, said first and second optical sensors being operated to issue first and second instructions to said control unit when said lights are intercepted from said light sources of said first and second optical sensors, respectively, by said sensor actuating portion of said lever arm, and wherein said control unit is operable to selectively perform said betting operation and said start operation in response to said first and second instructions received from said first and second optical sensors, respectively.

2. The game machine as set forth in claim 1, in which said resiliently urging member comprises a pair of tensile coil springs each having a center axis extending in perpendicular relationship to said center axis of said axle portion of said lever arm and said light paths of said first and second optical sensors and having one ends securely connected to said housing and the other ends securely connected to said rear half section of said rod portion of said lever arm.

3. The game machine as set forth in claim 1, further comprising a storage device for storing therein said betting condition.

4. A game machine for allowing a player to play a game through the steps of: determining a betting condition including a betting point and a prize-winning line under which said game is executed to evaluate a result of playing said game; starting to change an arrangement of different symbols at random; stopping changing said arrangement of said symbols; and evaluating said result of playing said game on the basis of said arrangement of said symbols and said determined betting condition to award a winning prize point to said player, comprising:

a housing having a front panel having a plurality of windows each displaying said symbols arranged thereon and changed at random at predetermined intervals;

a control unit for executing said game to perform a betting operation for accepting said betting condition under which said game is executed to evaluate the result of playing said game, to perform a start operation for starting to display through said windows said symbols changed at random and to perform a stop operation for stopping changing said symbols displayed through said windows to evaluate said result of playing said game on the basis of said betting condition to award said winning prize point to said player by judging whether said symbols on said prize-winning line are identical with each other or not;

a lever arm including a rod portion having a front half section extending outwardly of said housing and a rear half section extending inwardly of said housing, an axle portion integrally formed with the longitudinally intermediate portion of said rod portion and having a horizontal axis and a vertical axis substantially perpendicular to the center axis of said rod portion, said axle portion being pivotally supported on said housing and pivotal about said horizontal and vertical axes, a handle portion integrally formed with the front end of said rod portion and movable to assume four different positions consisting of neutral, first, second and third positions, said second and third positions substantially opposite to each other, said neutral position located within said first, second and third positions, and a reflecting portion for reflecting a light and integrally formed with the rear end of said rod portion, said rod portion being pivotable around said horizontal and vertical axes of said axle portion to cause said rod portion to be rockable about said horizontal and vertical axes of said axle portion to ensure that said handle portion is movable to said first, second and third positions from said neutral position;

a resiliently urging member for resiliently urging said rod portion of said lever arm toward said neutral position from said first, second and third positions; and a first optical sensor including a light source for projecting a light and a light detector for detecting the light projected from said light source, said first optical sensor being positioned to have said projected light reflected by said reflecting portion of said rod portion of said lever arm toward said light detector of said first optical sensor when said rod portion of said lever arm is located at said neutral position;

a second optical sensor including a light source for projecting a light and a light detector for detecting the light projected from said light source, said second optical sensor being positioned to have said projected light reflected by said reflecting portion of said rod portion of said lever arm toward said light detector of said second optical sensor when said rod portion of said lever arm is located at said first position;

wherein said first optical sensor being operated to issue a first instruction to said control unit when said light detector of said first optical sensor is prevented from detecting said light projected from said light source of said first optical sensor, said second optical sensor being operated to issue a second instruction to said control unit when said light detector of said second optical sensor is operated to detect said light projected from said light source of said second optical sensor, and wherein said control unit is operable to selectively perform said betting and start operations in response to said first and second instructions received from said first and second optical sensors, respectively.

5. The game machine as set forth in claim 4, in which said resiliently urging member comprises two pairs of tensile coil springs each having a center axis extending in parallel relationship with said horizontal and vertical axes of said axle portion of said lever arm, said horizontal and vertical axes of said two pairs of tensile coil springs substantially perpendicular to each other and said two pairs of tensile coil springs each having one ends securely connected to said housing and the other ends securely connected to said rear half section of said rod portion of said lever arm.

6. The game machine as set forth in claim 4, further comprising a storage device for storing therein said betting condition.

7. A game machine for allowing a player to play a game comprising:

control means for executing said game; and handling means for allowing said player to instruct said control means to perform first and second predetermined operations and for issuing first and second predetermined instructions, respectively, to said control means, wherein said control means is operable to selectively perform said first and second operations in response to said first and second instructions, respectively.

8. A game machine for allowing a player to play a game through the steps of: determining a betting condition including a betting point and a prize-winning line under which said game is executed to evaluate a result of playing said game; starting to change an arrangement of different symbols at random; stopping changing said arrangement of said symbols; and evaluating said result of playing said game on the basis of said arrangement of said symbols and said determined betting condition to award a winning prize point to said player, comprising:

a housing having a front panel having a plurality of windows each displaying said symbols arranged thereon and changed at random at predetermined intervals;

a control unit for executing said game to perform a betting operation for accepting said betting condition under which said game is executed to evaluate the result of playing said game, to perform a start operation for starting to display through said windows said symbols changed at random and to perform a stop operation for stopping changing said symbols displayed through said windows to evaluate said result of playing said game on the basis of said betting condition to award said winning prize point to said player by judging whether said symbols on said prize-winning line are identical with each other or not;

a lever arm including a rod portion having a front half section extending outwardly of said housing and a rear half section extending inwardly of said housing, an axle portion integrally formed with the longitudinally intermediate portion of said rod portion and having a center axis substantially perpendicular to the center axis of said rod portion, said axle portion being pivotally supported on said housing and pivotal about said center axis thereof, a handle portion integrally formed with the front end of said rod portion and movable to assume three different positions consisting of neutral, upper and lower positions, said neutral position located between said upper and lower positions, and a sensor actuating portion integrally formed with the rear end of said rod portion, said rod portion being pivotable around said center axis of said axle portion to cause said rod portion to be upwardly and downwardly rockable about said center axis of said axle portion to ensure that said handle portion is movable to said upper position and said lower position from said neutral position;

a resiliently urging member for resiliently urging said rod portion of said lever arm toward said neutral position from said upper and lower positions; and first and second optical sensors each including a light source for projecting a light on a light path substantially perpendicular to said center axis of said rod portion of said lever arm and a light detector for detecting the light projected from said light source, said first and second optical sensors being vertically spaced apart from each other to have said light paths substantially parallel with each other, said first optical sensor being positioned to have said projected light intercepted by said sensor actuating portion of said lever arm when said rod portion of said lever arm is located at said lower position, and said second optical sensor being positioned to have said projected light intercepted by said sensor actuating portion of said lever arm when said rod portion of said lever arm is located at said upper position, said first and second optical sensors being operated to issue first and second instructions to said control unit when said lights are intercepted from said light sources of said first and second optical sensors, respectively, by said sensor actuating portion of said lever arm, and wherein said control unit is operable to selectively perform said betting operation and said start operation in response to said first and second instructions received from said first and second optical sensors, respectively.

9. The game machine as set forth in claim 8, in which said resiliently urging member comprises a pair of tensile coil springs each having a center axis extending in perpendicular relationship to said center axis of said axle portion of said lever arm and said light paths of said first and second optical sensors and having one ends securely connected to said housing and the other ends securely connected to said rear half section of said rod portion of said lever arm.

10. The game machine as set forth in claim 8, further comprising a storage device for storing therein said betting condition.

11. A game machine for allowing a player to play a game through the steps of: determining a betting condition including a betting point and a prize-winning line under which said game is executed to evaluate a result of playing said game; starting to change an arrangement of different symbols at random; stopping changing said arrangement of said symbols; and evaluating said result of playing said game on the basis of said arrangement of said symbols and said determined betting condition to award a winning prize point to said player, comprising:

a housing having a front panel having a plurality of windows each displaying said symbols arranged thereon and changed at random at predetermined intervals;

a control unit for executing said game to perform a betting operation for accepting said betting condition under which said game is executed to evaluate the result of playing said game, to perform a start operation for starting to display through said windows said symbols changed at random and to perform a stop operation for stopping changing said symbols displayed through said windows to evaluate said result of playing said game on the basis of said betting condition to award said winning prize point to said player by judging whether said symbols on said prize-winning line are identical with each other or not;

a lever arm including a rod portion having a front half section extending outwardly of said housing and a rear half section extending inwardly of said housing, an axle portion integrally formed with the longitudinally intermediate portion of said rod portion and having a center axis substantially perpendicular to the center axis of said rod portion, said axle portion being pivotally supported on said housing and pivotal about said center axis thereof, a handle portion integrally formed with the front end of said rod portion and movable to assume three different positions consisting of neutral, rightward and leftward positions, said neutral position located between said rightward and leftward positions, and a sensor actuating portion integrally formed with the rear end of said rod portion, said rod portion being pivotable around said center axis of said axle portion to cause said rod portion to be rockable about said center axis of said axle portion to ensure that said handle portion is movable to said rightward and leftward positions from said neutral position;

a resiliently urging member for resiliently urging said rod portion of said lever arm toward said neutral position from said rightward and leftward positions; and first and second optical sensors each including a light source for projecting a light on a light path substantially perpendicular to said center axis of said rod portion of said lever arm and a light detector for detecting the light projected from said light source, said first and second optical sensors being spaced apart from each other to have said light paths substantially parallel with each other, said first optical sensor being positioned to have said projected light intercepted by said sensor actuating portion of said lever arm when said rod portion of said lever arm is located at said rightward position, and said second optical sensor being positioned to have said projected light intercepted by said sensor actuating portion of said lever arm when said rod portion of said lever arm is located at said leftward position, said first and second optical sensors being operated to issue first and second instructions to said control unit when said lights are intercepted from said light sources of said first and second optical sensors, respectively, by said sensor actuating portion of said lever arm, and wherein said control unit is operable to selectively perform said betting operation and said start operation in response to said first and second instructions received from said first and second optical sensors, respectively.

12. The game machine as set forth in claim 11, in which said resiliently urging member comprises a pair of tensile coil springs each having a center axis extending in perpendicular relationship to said center axis of said axle portion of said lever arm and said light path of said first and second optical sensors and having one ends securely connected to said housing and the other ends securely connected to said rear half section of said rod portion of said lever arm.

13. The game machine as set forth in claim 11, further comprising a storage device for storing therein said betting condition.

* * * * *